US005649529A

United States Patent [19]

Lu et al.

[11] Patent Number: 5,649,529

[45] Date of Patent: Jul. 22, 1997

[54] LOW $NO_x$ COMBUSTION SYSTEM FOR FUEL-FIRED HEATING APPLIANCES

[75] Inventors: Lin-Tao Lu; Larry R. Mullens; Keith M. Grahl, all of Fort Smith, Ak.

[73] Assignee: Rheem Manufacturing Company, New York, N.Y.

[21] Appl. No.: 542,194

[22] Filed: Oct. 12, 1995

[51] Int. Cl.[6] ..... F24H 3/00

[52] U.S. Cl. ..... 126/116 R; 126/99 A; 126/110 R; 431/353; 431/352

[58] Field of Search ..... 431/354, 118, 431/352, 353; 126/99 A, 110 R, 116 R

[56] References Cited

U.S. PATENT DOCUMENTS

| | | | |
|---|---|---|---|
| 1,305,436 | 6/1919 | Blanchard . | |
| 2,720,257 | 10/1955 | Lynes | 158/99 |
| 3,131,749 | 5/1964 | Davis, Sr. | 158/4 |
| 3,737,281 | 6/1973 | Guth | 431/352 |
| 4,062,343 | 12/1977 | Spielman | 126/91 A |
| 4,149,842 | 4/1979 | Benjamin | 431/118 |
| 4,203,719 | 5/1980 | Prandt | 431/352 |
| 4,776,320 | 10/1988 | Kipka et al. | 126/99 A |
| 4,974,579 | 12/1990 | Shellenberger et al. | 126/110 R |
| 5,146,910 | 9/1992 | Grahl et al. | 126/110 R |
| 5,333,597 | 8/1994 | Kirkpatrick et al. | 126/110 R |
| 5,370,529 | 12/1994 | Lu et al. | 431/353 |
| 5,520,536 | 5/1996 | Rodgers et al. | 126/116 |
| 5,546,925 | 8/1996 | Knight et al. | 126/110 R |

*Primary Examiner*—Larry Jones
*Attorney, Agent, or Firm*—Konneker & Smith

[57] ABSTRACT

A fuel-fired, forced air, draft induced heating furnace is provided with NOx reduction apparatus associated with a plurality of combustor tubes forming a portion of its heat exchanger structure. In-shot type fuel burners are spaced apart from and face the open inlet ends of horizontal combustion sections of the combustor tubes. The NOx reduction apparatus includes a plurality of metal mesh tubes having diameters substantially less than the internal diameters of the combustion tubes. Each metal mesh tube is coaxially anchored to and telescopingly over the outlet end of one of the burners and extends therefrom coaxially into the associated combustion tube. During burner operation the burner flames injected into the combustor tubes are forced through the mesh tubes which operate to laterally reduce the cross-sections of the flames, increase their axial velocity through the combustor tubes, and substantially diminish the intimate contact of secondary combustion air with the maximum temperature zones of the flames within the combustor tubes.

12 Claims, 3 Drawing Sheets

LOW $NO_X$ COMBUSTION SYSTEM FOR FUEL-FIRED HEATING APPLIANCES

BACKGROUND OF THE INVENTION

The present invention generally relates to fuel-fired heating appliances, such as furnaces, water heaters and boilers and, in a preferred embodiment thereof, more particularly relates to apparatus and methods for reducing NOx emissions generated by the combustion systems in such appliances.

Nitrogen oxide (NOx) emissions in fuel-fired heating appliances, such as furnaces, water heaters and boilers, are a product of the combustion process, and are formed when the combustion reaction takes place at high temperature conditions typically encountered in such heating appliances. NOx emissions became an environmental issue in the late 1960's and early 1970's due to their detrimental role in atmospheric visibility, photochemical smog and acid deposition. Regulations in the subsequent decade led to significantly reduced amounts of NOx emissions.

Current SCAQMD (South Coast Air Quality Management District) regulations for residential furnaces and water heaters limit NOx emissions to 40 ng/j of useful heat generated by these types of fuel-fired appliances. Growing environmental concern has led to proposals for even more stringent regulation of NOx emissions. Conventional fuel-fired appliance combustion systems are not currently capable of meeting these more stringent limitations.

One technique currently used to lower NOx emissions in fuel-fired heating appliances is to position a heat absorbing flame insert within the burner flame path for "quenching" purposes. The resulting lowered combustion flame temperature results in lowered NOx emission rates. For example, as shown in U.S. Pat. No. 5,146,910, flame cooling can be achieved by placing an insert within the burner flame zone. The insert receives heat from the flame and radiates heat away to thereby cool the flame. Using this quenching technique, gas furnaces with flame inserts are now in commercial production and have NOx emission rates of somewhat less than about 40 ng/j.

Flame insert methods are relatively easy and inexpensive to implement. However, NOx reduction achieved by existing flame inserts is rather limited because conventional flame insert designs are operative solely through a flame cooling mechanism and, for a given combustion system, only limited flame cooling can be realized without jeopardizing the combustion process itself. Due to this practical limitation, existing flame inserts are typically not able to reduce NOx emissions to the proposed lowered permissible limits thereof.

Some advanced combustion systems such as infrared/porous matrix surface burners, catalytic combustion and fuel/air staging could reach a very low NOx emission level in compliance with these proposed emission standards, but these methods tend to be quite expensive and usually require extensive system modification. Accordingly, they are not suited for retrofitting existing combustion systems to achieve the desired substantial reduction in system NOx emissions.

From the foregoing it can be seen that it would be highly desirable to provide improved NOx reduction apparatus, for use in fuel-fired heating appliances of the type generally described above, which will enable the meeting of the proposed NOx emission standards in a cost-effective manner and is suitable for retrofitting existing combustion systems with the reduction apparatus. It is accordingly an object of the present invention to provide such improved NOx reduction apparatus.

SUMMARY OF THE INVENTION

In carrying out principles of the present invention, in accordance with a preferred embodiment thereof, a reduced NOx emission combustion system is incorporated in a fuel-fired heating appliance, representatively a forced air furnace.

The combustion system includes a spaced plurality of combustor tubes having open inlet ends and essentially straight combustion sections longitudinally extending inwardly from the open inlet ends. A laterally spaced plurality of longitudinally parallel fuel burners, representatively of the in-shot type, are operative to inject flames and resulting hot combustion gases into the open inlet ends of the combustor tubes for flow through their combustion sections in a manner drawing ambient secondary combustion air into the combustion sections around the flames. The fuel burners have generally cylindrical flame outlet sections from which the flames are discharged. The flame outlet sections of the burners are coaxial with the combustion sections and have diameters substantially smaller than the internal diameters of the combustor tube combustion sections.

Perforate tubular flame control members have first longitudinal portions, including discharge ends, coaxially supported in the combustion section and have a diameters substantially less than the internal diameter of the combustor tube. Each tubular flame control member is preferably formed from a metal mesh material and is operative to cause an axial portion of its associated fuel burner flame to longitudinally pass therethrough in a manner reducing the lateral dimension of the axial flame portion, increasing its velocity, and substantially shielding it from intimate contact with the ambient secondary combustion air entering the combustion section around the burner flame. This action of the flame control members on the injected burner flames very substantially reduces the NOx emissions of the furnace.

According to a key aspect of the present invention, the perforate tubular flame control members have second longitudinal portions, including inlet ends of the flame control members, telescopingly engaged with and anchored to the outlet ends of the fuel burners in a manner supporting the perforate tubular flame control members on the burners and causing the flame control members to define downstream extensions of the burners. Preferably, each laterally adjacent pair of flame control members has formed therein, adjacent their associated burner outlet end, facing flame carryover side openings. Representatively, the second longitudinal flame control member portions are telescoped over the discharge ends of the burners and brazed or spot welded thereto.

Because the perforate tubular flame control members are supported on the discharge ends of their associated fuel burners, the need for supplemental supporting parts for the flame control members is advantageously eliminated, and the overall cost of the NOx reduction structure is correspondingly reduced. Moreover, by supporting the flame control members directly on their associated burners, the need for support structures within the combustor tubes, to maintain the flame control members in centered relationships therein, is also eliminated. Further, by supporting the tubular flame control members directly on their associated burner discharge ends the flame control members may be correctly positioned and operatively held within their associated combustor tubes regardless of the installed orientations of the heat exchanger portion of the fuel-fired furnace.

DETAILED DESCRIPTION

Figure 1:
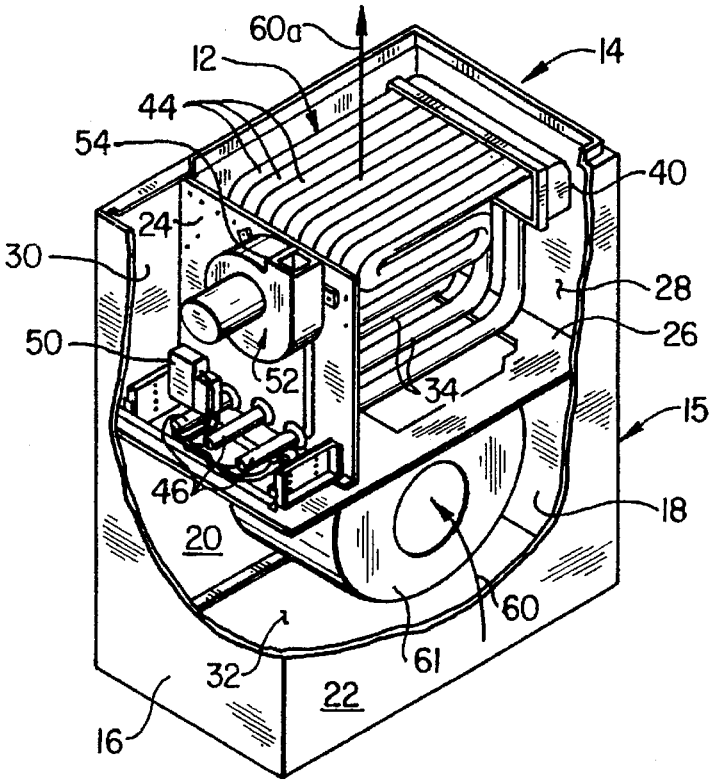
FIG. 1 is a partially cut away perspective view of a representative forced air, fuel-fired furnace incorporating therein specially designed NOx reducing apparatus embodying principles of the present invention.
Figure 2:
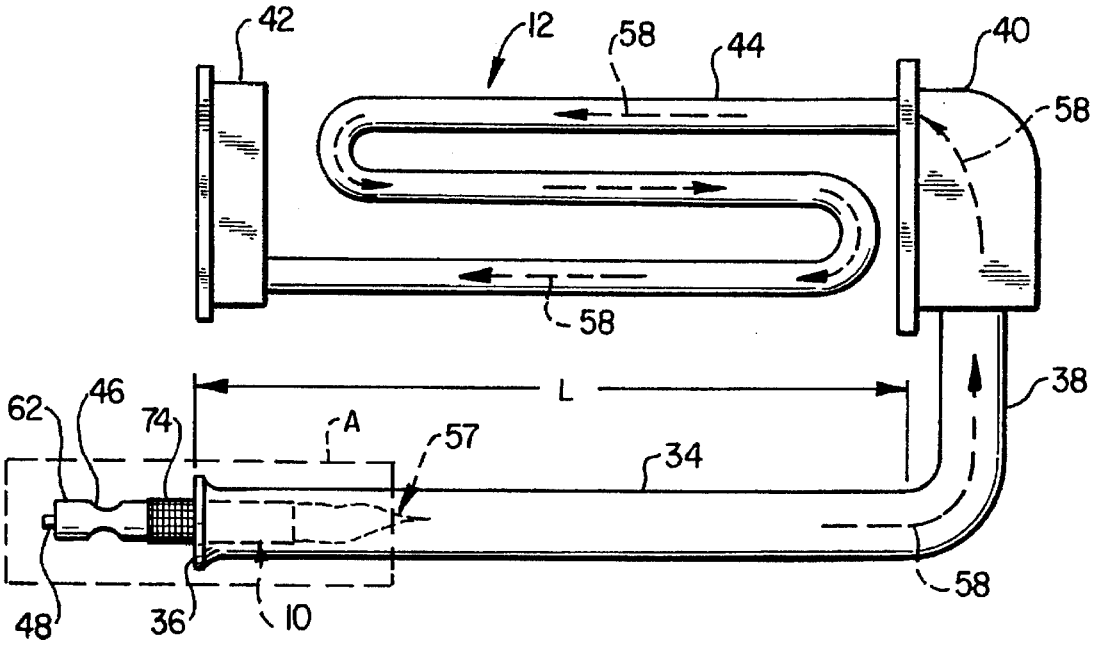
FIG. 2 is an enlarged scale side elevational view of the heat exchanger portion of the furnace.

This application contains subject matter similar to that illustrated and described in U.S. Pat. No. 5,370,529 issued on Dec. 6, 1994 and assigned to the assignee of the present application. As later described herein the present invention provides specially designed NOx reduction apparatus 10 (schematically illustrated in FIG. 2) for incorporation in the combustion systems of fuel-fired heating appliances such as furnaces, water heaters and boilers. By way of example the NOx reduction apparatus is shown in FIGS. 1 and 2 as being operatively installed in the heat exchanger section 12 of a high efficiency fuel-fired heating furnace 14 as illustrated and described in U.S. Pat. No. 4,974,579.

Referring initially to FIGS. 1 and 2, the furnace 14 includes a generally rectangularly cross-sectioned housing 15 having vertically extending front and rear walls 16 and 18, and opposite side walls 20 and 22. Vertical and horizontal walls 24 and 26 within the housing 15 divide the housing interior into a supply plenum 28 (within which the heat exchanger 12 is positioned), a fan and burner chamber 30, and an inlet plenum 32 beneath the plenum 28 and the chamber 30.

Heat exchanger 12 includes three relatively large diameter, generally L-shaped primary combustor flame tubes 34 which are horizontally spaced apart and secured at their open inlet ends 36 to a lower portion of the interior vertical wall 24. As best illustrated in FIG. 2, each of the combustor tubes 34 has an essentially straight horizontal combustion section L extending inwardly from its inlet end 36. The upturned outlet ends 38 of the tubes 34 are connected to the bottom side of an inlet manifold 40 which is spaced rightwardly apart from a discharge manifold 42 suitably secured to an upper portion of the interior wall 24. The interior of the inlet manifold 40 is communicated with the interior of the discharge manifold 42 by means of a horizontally spaced series of vertically serpentined flow transfer tubes 44 each connected at its opposite ends to the manifolds 40,42 and having a considerably smaller diameter than the combustor tubes 34.

Three horizontally spaced apart "in-shot" type gas burners 46 are operatively mounted within a lower portion of the chamber 30 and are supplied with gaseous fuel (such as natural gas) through supply piping 48 by a gas valve 50. As can be seen in FIG. 2, each burner 46 is spaced outwardly apart from, and faces, the open inlet end 36 of its associated combustor tube 34. It will be appreciated that a greater or lesser number of combustor tubes 34, and associated burners 46 could be utilized, depending on the desired heating output of the furnace.

A draft inducer fan 52 positioned within the chamber 30 is mounted on an upper portion of the interior wall 24, above the burners 46, and has an inlet communicating with the interior of the discharge manifold 42, and an outlet section 54 that may be operatively coupled to an external exhaust flue (not shown).

Upon a demand for heat from the furnace 14, by a thermostat (not illustrated) located in the space to be heated, the burners 46 and the draft inducer fan 52 are energized. As best illustrated in FIG. 2, flames 57 and resulting hot products of combustion 58 from the burners 46 are directed into the open inlet ends 36 of the combustor tubes 34, and the combustion products 58 are drawn through the heat exchanger 12 by the operation of the draft inducer fan 52. Specifically, the burner combustion products 58 are drawn by the draft inducer fan, as indicated in FIG. 2, sequentially through the combustor tubes 34, into the inlet manifold 40, through the flow transfer tubes 44 into the discharge manifold 42, from the manifold 42 into the inlet of the draft inducer fan 52, and through the fan outlet section 54 into the previously mentioned exhaust flue to which the draft inducer outlet is connected.

At the same time return air 60 from the heated space is drawn upwardly into the inlet plenum 32 and flowed into the inlet of a supply air blower 61 disposed therein. Return air 60 entering the blower inlet is forced upwardly into the supply air plenum 28 through the illustrated opening in the interior housing wall 26. The return air 60 is then forced upwardly and externally across the heat exchanger 12 to convert the return air 60 into heated supply air 60*a* which is upwardly discharged from the furnace through its open top end to which a suitable supply ductwork system (not illustrated) is connected to flow the supply air 60*a* into the space to be heated.

Figure 4:
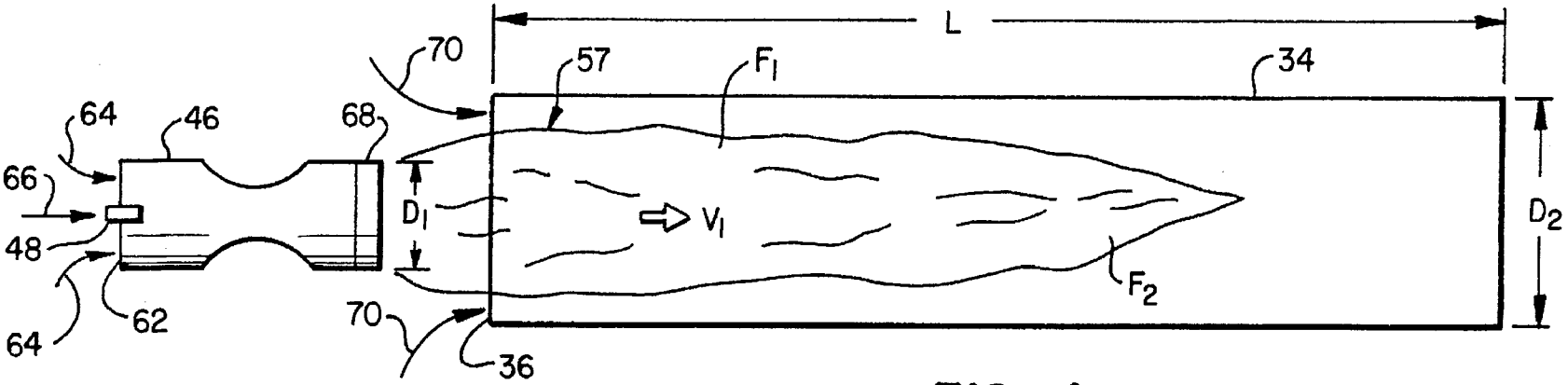
FIG. 4 (PRIOR ART)
FIG. 4 (PRIOR ART) is a highly schematic cross-sectional view through the combustor tube illustrating its conventional operation in the absence of the NOx reducing apparatus of the present invention.

FIG. 4 (PRIOR ART) schematically illustrates the operation of the combustor tubes 34, and the in-shot fuel burners 46 associated therewith, in the absence of the NOx reduction structures 10 installed within the combustor tubes as schematically indicated in FIG. 2. The illustrated inshot-type burners 46 are of a conventional construction and have open left or inlet ends 62 into which primary combustion air 64 is drawn during burner operation for mixture and combustion with fuel 66 delivered to the burner through piping 48 to produce the flame 57 injected into the open combustor tube end 36 associated with the burner.

At the right end of each burner 46 is a conventional flame holder structure 68 which is coaxial with its associated combustor tube inlet section 34. The flame holder 68 has a generally cylindrical shape with a diameter $D_1$ which is substantially smaller than the interior diameter $D_2$ of its associated combustor tube. Accordingly, the flame 57 issuing from the flame holder 68 also has a generally circular cross-section. As the flame 57 enters the combustor tube inlet end 36 its cross-section has increased to a diameter larger than that of the flame holder 68 and somewhat smaller than the interior tube diameter $D_2$.

The injected flame 57 has a velocity $V_1$, an upstream end section $F_1$ in which the flame temperature is generally at a maximum, and a downstream end section $F_2$ in which the flame temperature has diminished. By aspiration, the injection of the flame 57 into the combustor tube 34 draws secondary combustion air 70 into the tube around the high temperature flame zone $F_1$, the incoming secondary combustion air 70 intimately contacting and mixing with the flame zone $F_1$ and supporting the combustion of the injected flame 57. The conventional combustion air/flame mechanics just described in conjunction with FIG. 4 (PRIOR ART) creates in the furnace 14 NOx emissions which the NOx reduction structures 10 of the present invention uniquely and substantially reduce in a manner which will now be described.

Figure 3:
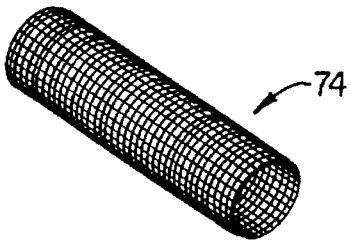
FIG. 3 is an enlarged scale perspective view of a metal mesh tube portion of the NOx reducing apparatus.
Figure 5:
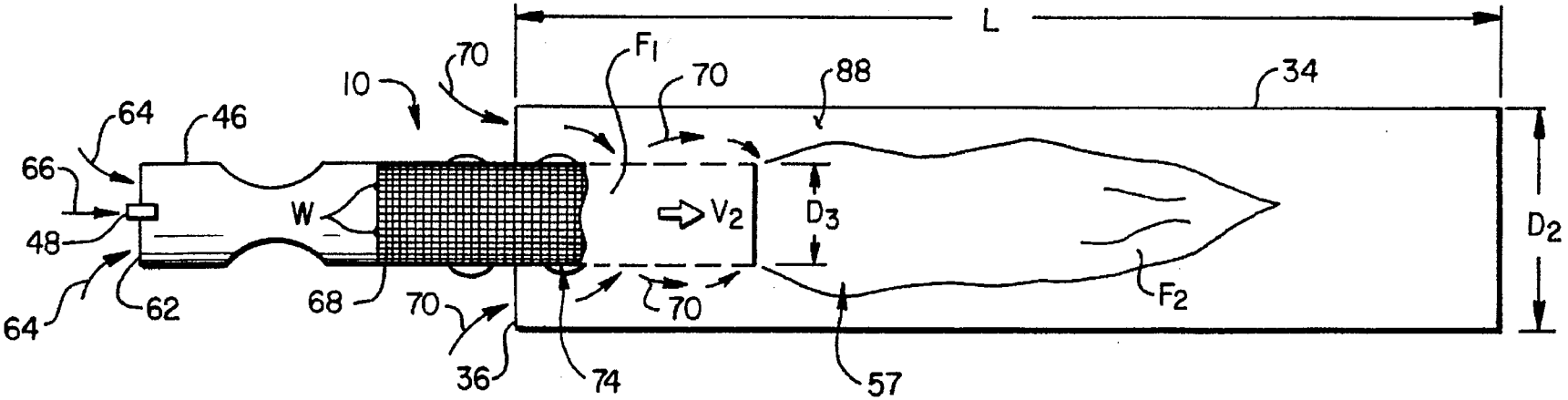
FIG. 5 is a highly schematic cross-sectional view through the combustor tube illustrating the operation of the NOx reducing apparatus.

Referring now to FIGS. 3 and 5, each NOx reduction structure 10 includes an elongated open-ended tubular metal mesh member 74 that functions as a flame control member as later described herein. Each metal mesh tube member 74 is insertable at one end thereof into an inlet end portion of one of the combustor tubes 34—either when the heat exchanger 12 is originally installed in the furnace 14, or later in a retrofit application. The opposite end of each tube 74 coaxially receives one of the burner flame holder portions 68 and is anchored thereto in a suitable manner such as by means of brazing or a series of tack welds W. As best illustrated in FIG. 5, each tubular metal mesh member 74 has a length substantially less than the length L of its associated combustor tube 34, and a diameter $D_3$ substantially less than the interior diameter $D_2$ of the combustor tube.

With continuing reference to FIG. 5, during firing of the illustrated burner 46 and operation of the draft inducer fan 52 the flame 57 is passed through the tubular metal mesh member 74, thereby reducing the diameter of the high temperature flame zone $F_1$, and increasing its velocity to $V_2$, compared to the conventional flame diameter and velocity $V_1$ depicted in FIG. 4. This alteration of the flame configuration, and the velocity of its high temperature zone $F_1$, achieved by the metal mesh tube portion 74 of the NOx reduction structure 10 the NOx generation of the flame is substantially reduced.

More specifically, due to the close coupling between the flame 57 and the tubular metal mesh member, and the associated interaction between the flame and the member 72 the high temperature zone $F_1$ of the flame is effectively confined within the envelope of the member 72, and the flame volume is laterally reduced in the zone thereof in which NOx production is the highest. In the present invention, the lateral flame confinement caused by the metal mesh tube 74 occurs continuously from the outlet end of the burner 46 to the downstream end of the tube 74. This reduced reaction zone volume and the short flue gas residence time due to the increased flame speed both contribute to reduced NOx formation.

In addition to its positive effect in changing the flame shape and speed, the NOx reduction structure 10 also alters the combustion air distribution pattern in a positive manner. Without the structure 10, as shown in FIG. 4, the flame 57 is totally exposed to the flow of secondary combustion air 70. In contrast, with the reduction structure 10 in place the perforate surface of the tubular member 74 serves as a barrier to secondary air penetration to and intimate contact with the high temperature flame region $F_1$, along essentially its entire length, thereby delaying the mixing between the primary flow from the burner 46 and the secondary combustion air. This reduced air availability at the high temperature flame zone, and the resultant delayed air/flame mixing, serve to further reduce the NOx formation rate.

The unique NOx reduction apparatus 10 of the present invention retains the advantages of in-shot type fuel burners and conventional flame inserts, such as low cost and high turn-down ratio. It provides a stable and clean combustion over a wide burner operation range, is inexpensive to manufacture and easy to install, and lends itself quite well to retrofit applications. And, quite importantly, it provides a high degree of NOx emission reduction. For example, in its representative forced air heating furnace application illustrated and described herein, the NOx reduction apparatus 10 is operative to reduce NOx emissions to below 30 ng/j.

Additionally, because the metal mesh tube 74 is supported at one end on the discharge end of its associated burner 46, the need for supplemental supporting parts for the tube is advantageously eliminated, and the overall cost of the NOx reduction structure 10 is reduced. Moreover, by supporting the metal mesh tube 74 directly on its associated burner discharge end, the need for support structure within the combustor tube 34, to maintain the tube 74 in a centered relationship within the combustor tube is also eliminated. Further, by supporting the tube 74 directly on its associated burner discharge end the tube may be correctly positioned and operatively held within the combustor tube regardless of the installed orientation of the heat exchanger portion of the fuel-fired furnace.

Figure 6:
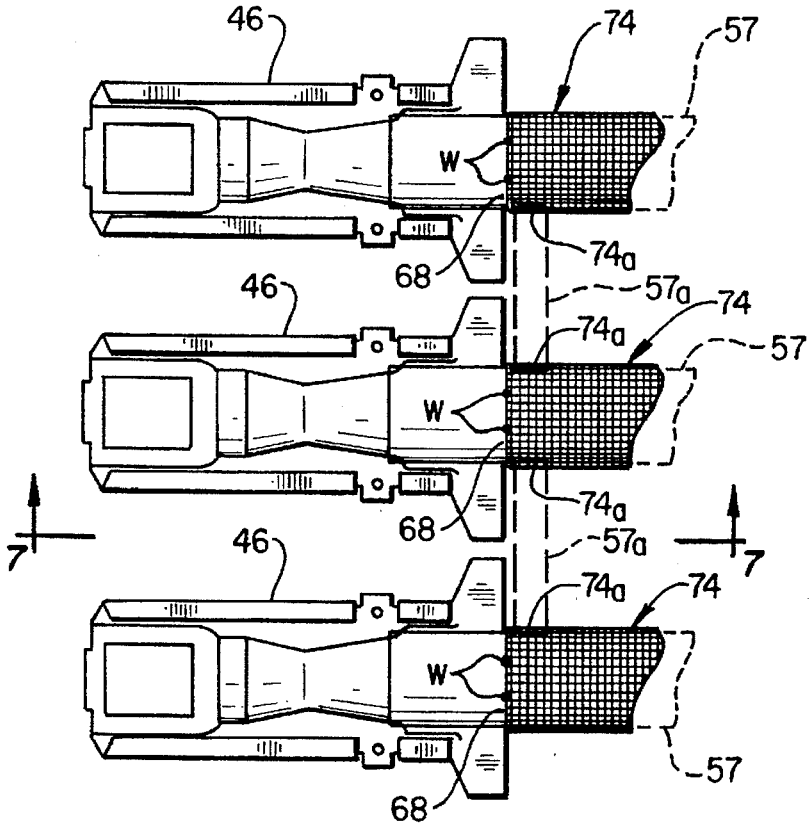
FIG. 6 is a top plan view of three representative inshot-type fuel burners having operatively installed on their outlet ends NOx reducing metal mesh NOx reducing tubes embodying principles of the present invention.
Figure 7:
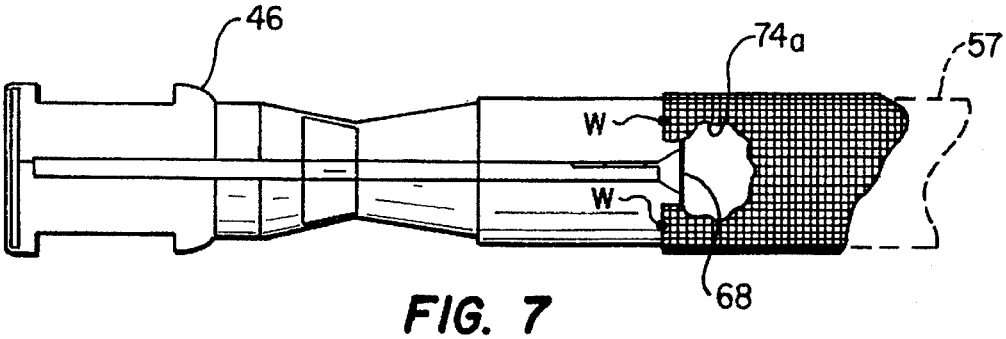
FIG. 7 is an enlarged scale side elevational view of one of the inshot-type burners, and its associated metal mesh tube, taken along line 7—7 of FIG. 6.

Turning now to FIGS. 6 and 7, to provide for flame propagation, or "carryover", from one burner to another, via lateral flame portions 57*a*, small side openings 74*a* are formed in the metal mesh tubes 74 near the junctures of the tubes with their associated burner flame holder portions 68. As illustrated, the tube openings 74*a* are positioned in appropriate facing pairs in each laterally facing pair of tubes. The tube flame carryover openings 74*a* are appropriately sized to allow the flame portions 57*a* to be easily carried over to adjacent burners at the designed-for minimum burner firing rate.

As will be readily appreciated, in the present invention the metal mesh tubes 74 define forward extensions of their associated burners, such extensions functioning to alleviate the adverse effects of high excess air in the formation of NOx emissions. These screen extensions alter the combustion air distribution pattern in a manner desirably lowering NOx emissions. Specifically, in conventional inshot-type fuel burners the flame is totally exposed to the combustion air flow. In contrast, with the screen extensions of the present invention in place, the surface of the extensions serve as barriers to secondary combustion air penetration. This reduces the air availability in the active combustion zone, thereby reducing NOx emissions.

Furthermore, the extension surface delays the mixing between the primary combustion air flow from the burner and the secondary combustion air in a manner further reducing the NOx formation rate. The present invention also provides a much less deleterious operating environment for the NOx reducing apparatus. Specifically, the overall surface temperature of the metal mesh burner extensions is substantially lower than conventional NOx reducing inserts because of the secondary air cooling. Conventional NOx reducing inserts typically have to be placed in the hottest flame zones in order to be effective, because they rely solely on the flame cooling mechanism. Unlike these conventional flame inserts, however, the NOx reducing structure of the present invention is not placed in the hottest flame portion, yet still very efficiently and substantially reduces NOx emissions during furnace operation.

The foregoing detailed description is to be clearly understood as being given by way of illustration and example only, the spirit and scope of the present invention being limited solely by the appended claims.

What is claimed is:

1. A reduced NOx emission combustion system for a fuel-fired heating appliance, comprising:

a combustor tube having an open inlet end and an essentially straight combustion section longitudinally extending inwardly from said open inlet end and having an internal diameter;

a fuel burner operative to inject a flame and resulting hot combustion gases into said open inlet end for flow through said combustion section of said combustor tube in a manner drawing ambient combustion air into said combustion section around the flame, said fuel burner having a generally cylindrical flame outlet section spaced outwardly apart from said open inlet end and from which the flame is discharged, said flame outlet section being coaxial with said combustion section and having a diameter substantially smaller than said internal diameter of said combustion section; and a perforate tubular flame control member having a first longitudinal portion, including a discharge end, coaxially disposed within said combustion section, said perforate tubular flame control member having a diameter substantially less than said internal diameter of said combustion section to thereby form between said perforate tubular flame control member and the interior side surface of said combustion section an annular combustion air flow space through which the ambient combustion air may flow in response to operation of said fuel burner, said perforate tubular flame control member having a second longitudinal portion including an inlet end section coaxially supported by said flame outlet section in a contiguous relationship therewith, said perforate tubular flame control member further having a diameter approximately equal to the diameter of said flame outlet section of said fuel burner and being operative to cause an axial portion of the fuel burner flame to longitudinally pass therethrough in a manner reducing the lateral dimension of the axial flame portion, increasing its velocity, and substantially shielding it from intimate contact with the ambient combustion air entering said combustion section around the flame and flowing through said annular combustion air flow space, whereby said perforate tubular flame control member, during operation of said combustion system, functions to substantially reduce the NOx emission level of said combustion system.

2. The combustion system of claim 1 wherein:

said flame control member is formed from a metal mesh material.

3. The combustion system of claim 1 wherein:

said fuel burner is an in-shot type fuel burner.

4. The combustion system of claim 1 wherein:

said inlet end section of said perforate tubular flame control member is telescoped with and anchored to said cylindrical flame outlet section of said fuel burner.

5. The combustion system of claim 4 further comprising:

at least one flame carryover side opening formed in said second longitudinal portion of said perforate tubular flame control member and extending downstream from said flame outlet section of said fuel burner.

6. The combustion system of claim 4 wherein:

said inlet end section of said perforate tubular flame control member is outwardly telescoped over said flame outlet section of said fuel burner.

7. The combustion system of claim 4 wherein:

said inlet end section of said perforate tubular flame control member is tack welded to said flame outlet section of said fuel burner.

8. The combustion system of claim 4 wherein:

said inlet end section of said perforate tubular flame control member is brazed to said flame outlet section of said fuel burner.

9. A combustion system for a fuel-fired heating appliance, comprising:

a combustor tube having an open inlet end and an essentially straight combustion section horizontally extending inwardly from said open inlet end and having an internal diameter;

an in-shot type fuel burner operative to inject a flame and resulting hot combustion gases into said open inlet end for flow through said combustion section of said combustor tube in a manner drawing ambient combustion air into said combustion section around the flame, said in-shot type fuel burner having a generally cylindrical outlet section from which the flame is discharged, said flame outlet section being coaxial with said combustion section and having a diameter substantially smaller than said internal diameter of said combustion section; and NOx reduction apparatus for substantially reducing the NOx emission rate of the heating appliance, said NOx reduction apparatus including:

a metal mesh tube having a diameter substantially smaller than the internal diameter of said combustion section, and support means for removably supporting a first longitudinal portion of said metal mesh tube, including a discharge end thereof, coaxially within said combustion section, adjacent said open inlet end, in a manner (1) causing the fuel burner flame to pass through and be laterally constricted and bounded along its periphery by said metal mesh tube during operation of said fuel burner, and (2) forming between said metal mesh tube and the interior surface of said combustion section an annular combustion air flow space through which the ambient combustion air may flow in response to operation of said fuel burner, whereby said metal mesh tube is operative to substantially shield the laterally constricted fuel burner flame within said metal mesh tube from combustion air traversing said annular combustion air flow space, said metal mesh tube having a second longitudinal portion, including an inlet end, telescopingly engaged with said flame outlet section of said fuel burner, and said support means including means for anchoring said second longitudinal portion of said metal mesh tube to said flame outlet section of said fuel burner, whereby said metal mesh tube defines a downstream extension of said fuel burner.

10. The combustion system of claim 9 further comprising:

at least one flame carryover side opening formed in said second longitudinal portion of said metal mesh tube and extending downstream from said flame outlet section of said fuel burner.

11. A fuel-fired forced air heating furnace comprising:

a housing;

a supply air blower operative to flow air to be heated through said housing;

a heat exchanger interposed in the supply air blower air flow path, for transferring combustion heat to the air being flowed through said housing, said heat exchanger including a plurality of combustor tubes each having an open inlet end, an internal diameter, an outlet end, and an essentially straight combustion section longitudinally extending inwardly from said open inlet end and having a length;

a spaced plurality of generally parallel, longitudinally aligned in-shot type fuel burners disposed in facing orientations with said open inlet ends of said combustor tubes and operative to inject flames and resulting hot combustion gases thereinto, said fuel burners having generally cylindrical flame holder sections coaxial with said open inlet ends of said combustor tubes and having diameters substantially less than the internal diameters of said combustor tubes, said fuel burners, during operation thereof, functioning to draw ambient air into said open inlet ends of said combustor tubes around the burner flames received therein;

a draft inducer fan having an inlet communicated with said outlet ends of said combustor tubes, said draft inducer fan being operative to draw hot combustion gases through said combustor tubes; and NOx reduction apparatus for substantially reducing the NOx emission rate of said furnace, said NOx reduction apparatus including:

a spaced plurality of metal wire mesh tubes having diameters substantially smaller than the internal diameters of said combustor tubes and approximately equal to the diameters of said flame holder sections of said fuel burners, support means for removably supporting first longitudinal portions of said metal mesh tube, including discharge ends thereof, coaxially within said combustion sections, adjacent said open inlet ends, in a manner (1) causing the fuel burner flames to pass through and be laterally constricted and bounded along their peripheries by said metal mesh tubes during operation of said fuel burners, and (2) forming between said metal mesh tubes and the interior surfaces of their associated combustion sections annular combustion air flow spaces through which the ambient combustion air may flow in response to operation of said fuel burners, whereby said metal mesh tubes are operative to substantially shield the laterally constricted fuel burner flames within said metal mesh tubes from combustion air traversing said annular combustion air flow spaces, said metal mesh tubes having second longitudinal portions, including inlet ends, telescopingly engaged with said flame outlet sections of said fuel burners, and said support means including means for anchoring said second longitudinal portions of said metal mesh tubes to said flame outlet sections of said fuel burners, whereby said metal mesh tubes define downstream extensions of said fuel burner.

12. The furnace of claim 11 further comprising:

flame carryover side openings formed in facing side portions of each adjacent pair of said metal mesh tubes adjacent their associated fuel burner flame holder sections.

* * * * *